US005212732A

United States Patent [19]

Hipps et al.

[11] Patent Number: 5,212,732

[45] Date of Patent: May 18, 1993

[54] EFFECTS SPEAKER SYSTEM

[75] Inventors: Jeffrey L. Hipps, Whittier; Stephen R. Stokes, Montebello, both of Calif.

[73] Assignee: Lancer Electronics, Santa Fe Springs, Calif.

[21] Appl. No.: 848,672

[22] Filed: Mar. 5, 1992

[51] Int. Cl.[5] ..... H04R 1/02

[52] U.S. Cl. ..... 381/89; 381/24; 381/188; 381/205

[58] Field of Search ..... 381/24, 88, 89, 90, 381/188, 205

[56] References Cited

U.S. PATENT DOCUMENTS

| | | | |
|---|---|---|---|
| 3,838,216 | 9/1974 | Watkins | 381/195 |
| 4,182,931 | 1/1980 | Kenner | 381/89 |
| 4,586,192 | 4/1986 | Arntson | 381/195 |
| 5,073,945 | 12/1991 | Kageyama et al. | 381/89 |

FOREIGN PATENT DOCUMENTS

| | | | |
|---|---|---|---|
| 55-25265 | 2/1980 | Japan | 381/195 |

OTHER PUBLICATIONS

Newman, R. J., Article entitled Dipole Radiator Systems, Presented on Nov. 30, 1978, Audio Engineering Society Preprint.

Holman, Tomlinson, Article: New Factors in Sound for Cinema and Television, Presented Sep. 21-25, 1990, Audo Engineering Society Preprint.

*Primary Examiner*—Forester W. Isen

*Attorney, Agent, or Firm*—Lyon & Lyon

[57] ABSTRACT

There is disclosed herein a loudspeaker system of the dipole type, particularly for use in surround sound, reverberation and similar applications. An exemplary embodiment of the speaker system comprises a pair of woofers having dual voice coil drivers mounted on oppositely facing baffles (e.g., front and rear facing). Preferably, each baffle also includes a high frequency speaker mounted thereon. On a first baffle (e.g., front), both voice coils of the dual voice coil driver and the voice coil of the high frequency speaker are driven in-phase, and on the other baffle (e.g., rear), the second voice coil of the dual voice coil driver and the voice coil of the high frequency speaker are driven out-of-phase from those from the first baffle but in-phase with one another. The coils of the speakers are driven from suitable filter circuits.

15 Claims, 8 Drawing Sheets

EFFECTS SPEAKER SYSTEM

BACKGROUND OF THE INVENTION

The present invention relates to loudspeaker systems, and more particularly to a dipole type speaker system such as for use in surround sound, reverberation and similar applications.

Various forms of loudspeaker systems have been developed, and the types of speakers as well as the technologies involved pertaining to woofers, tweeters, mid-range and other forms of speaker systems are well known. Stereo sound systems using front speakers with or without some form of woofer or subwoofer, along with rear and/or side speakers, have become prevalent particularly for sound systems used to reproduce sound in "home theater" video systems for playing back video motion pictures and similar program material. The typical installation comprises a pair of front speakers positioned to either side of the TV screen, preferably with a center speaker and/or a subwoofer, and along with a pair of right and left side speaker and/or a pair of left and right rear speakers.

An Audio Engineering Society (AES) paper entitled "New Factors in Sound for Cinema and Television" by Tomlinson Holman, presented at the 89th Convention of the Audio Engineering Society, Los Angeles, Calif., Sep. 21–25, 1990, and reprinted in the Journal of the AES, Volume 39, No. 7/8, (preprint #2945) notes that the best directivity pattern for the "surround" loudspeakers is not the conventional forward radiating direct radiator, but rather dipolar radiation with the principal lobes of the dipole pointed, not at the listening area, but at the room surfaces with the null in the radiation pattern pointed at listeners, and that the best surround loudspeaker is physically invisible. FIG. 1*a* of the drawings illustrates a simple prior art dipole speaker with baffle, and FIG. 2*a* illustrates its radiation pattern, and FIG. 1*b* shows a prior art boxed dipole speaker with FIG. 2*b* illustrating the radiation pattern thereof. On the other hand, FIG. 1*c* illustrates a prior art bipolar speaker designed to be omni-directional at low frequencies, and FIG. 2*c* illustrates the radiation pattern thereof. It will be noted from FIG. 2*b* that the null is capable of being directed toward the listener (for example, positioned physically where the 270° marking is on the drawing). In this regard, FIG. 2*d* illustrates a listener 10, along with right 11 and left 12 radiation patterns from dipole speakers of the type shown in FIG. 1*a* or 1*b* with the nulls of the two speakers on each side pointed at the listener 10.

Unfortunately, available embodiments of speaker systems meeting the foregoing criteria generally involve mounting a relatively large (e.g. 9 ½×12×12 inches, 16 ½×9 ½×7 ¾ inches, etc.) speaker on sides of the room adjacent to the listening area and with five feet being the preferred shortest distance from each side speaker to the listener. Such large size speakers is in some respects essentially mandated by Dolby Laboratories requirements that the surround speaker be capable of reproducing one hundred Hertz and by the suggestion in the above AES paper that dipole radiation is best.

Furthermore, as is well know, bass frequencies reproduced by dipole radiators begin to cancel at frequencies dependent on the size of the baffle on which they are mounted. It has been pointed out in an AES paper entitled "Dipole Radiator Systems" by R. J. Newman presented at the 61st AES Convention, Nov. 3–6, 1978, (AES Preprint No. 1395 (M-1)), as well as other sources, that the baffle size requirements may be reduced if the dipole is mounted against a plane surface. However, this still requires an average baffle dimension of four feet for a pure dipole mounted on a wall for a response down 3 dB at 100 Hz. It is understood that the procedure used by at least one licensee of the Lucasfilm THX Home System is to eliminate the bass response from one of the two bass drivers used to create the dipole radiation pattern by placing a high pass filter in series with only one of the drivers, rolling off its bass response, and thereby eliminating one of the sources used to create the cancellation.

SUMMARY OF THE INVENTION

The present invention is directed to a loudspeaker system which is substantially smaller than existing speaker systems, and can be in one embodiment, for example, eight and one fourth inches wide by seven and one fourth inches high by six inches deep and in a tapering enclosure that resembles the look of a metronome. In another example the system can be eleven inches long by six inches high and eight and one-half inches wide and be "wedge" shaped and resemble an "exit" sign shape. A speaker of the present system has superior installation flexibility and can be mounted on a ceiling above the listening area, on the wall adjacent the listening area, or on a table beside the listening area. The speakers work equally well also to generate reverberation and echo effects when used with Digital Signal Processing (DSP) equipment or to generate "surround sound effects" when used with Dolby Pro-Logic equipment. The criteria for the present effects speakers is that the amplitude response should be flat at approximately seventy degrees off axis, and this represents a typical listening angle when the speakers are appropriately installed.

According to an exemplary embodiment of the present invention, the effects speaker utilizes two dual voice coil four inch drivers. Below 200 Hz, one voice coil of each driver is driven in phase, thereby allowing their bass energy to combine. Above 200–250 Hz, for example, a second voice coil of one driver (e.g., the rear) is driven out-of-phase with respect to the second voice coil of the other driver, allowing for dipole cancellation in the mid-range and high frequencies. All the drivers can be operated through the same network, and the drivers responsible for the dipole cancellation effect can have the same phase response and produce a more exact cancellation and null than found in speakers that roll-off the bass response of one woofer. Tweeters or other forms of high frequency speakers also can be included. One high frequency speaker (e.g., the rear) is driven out-of-phase with respect to the other high frequency speaker.

As will be explained in more detail and as a specific example of an effects speaker having front and rear dual voice coil speakers and associated front and rear tweeters, the voice coils (three) of the front speakers (one dual voice coil speaker and one tweeter) are all connected in phase, and a first voice coil of the dual voice coil rear speaker is also connected in phase and its second voice coil is connected out-of-phase and the coil of the rear tweeter also is connected out-of-phase (thus, the latter two are in-phase with each other, but out-of-phase with the other three voice coils).

Accordingly, it is a principal object of the present invention to provide an improved speaker system.

Another object of this invention is to provide an improved form of dipole speaker system.

These and other objects, features and advantages of the present invention will become better understood through a consideration of the following description, taken in conjunction with the drawings in which:

DETAILED DESCRIPTION

Figure 1A:
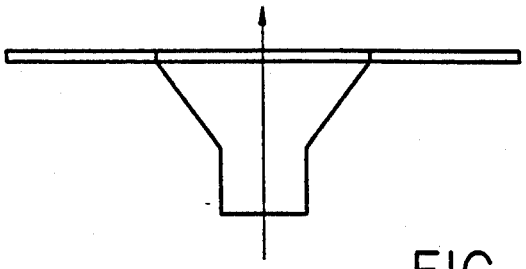
FIG. 1a. (PRIOR ART)
FIGS. 1a–1c illustrate known dipole speaker systems.
Figure 1B:
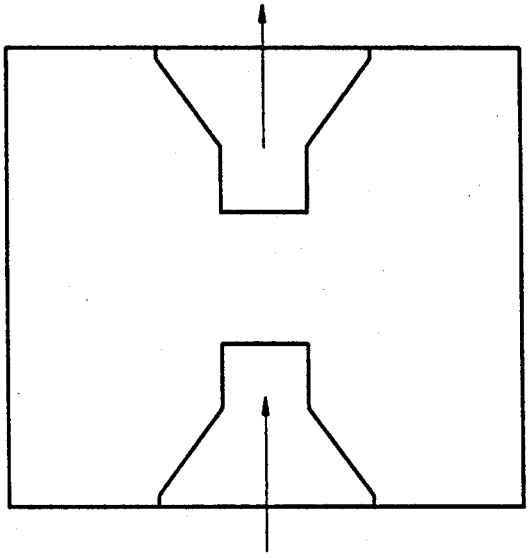
FIG. 1b. (PRIOR ART)
Figure 1C:
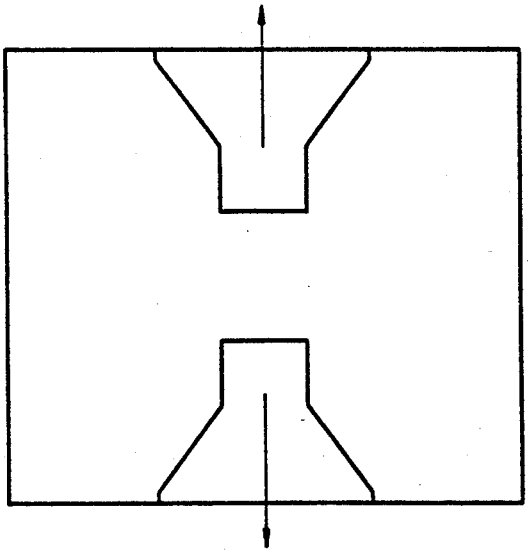
FIG. 1c. (PRIOR ART)
Figure 2A:
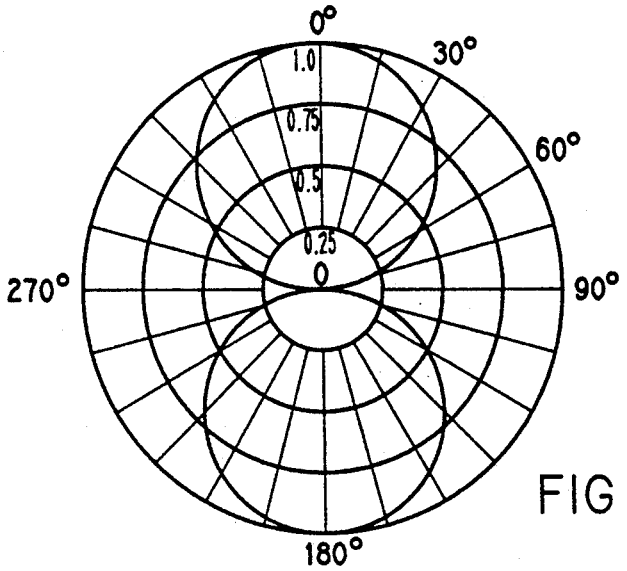
FIGS. 2a–2c illustrate the radiation patterns of the respective speakers of FIGS. 1a–1c.
Figure 2B:
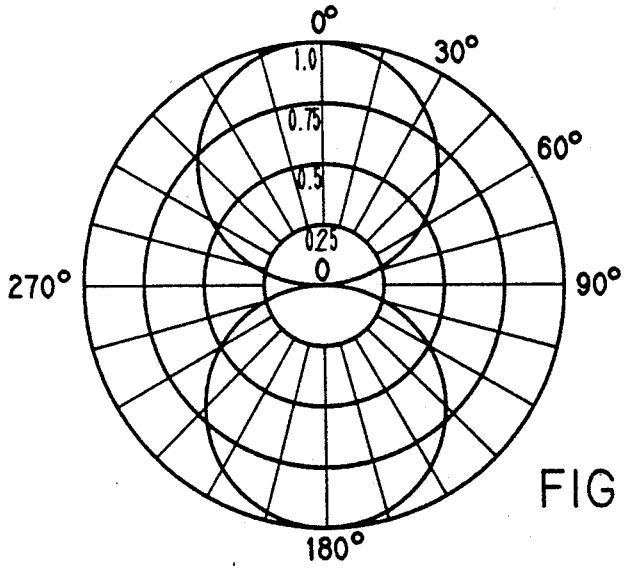
Figure 2C:
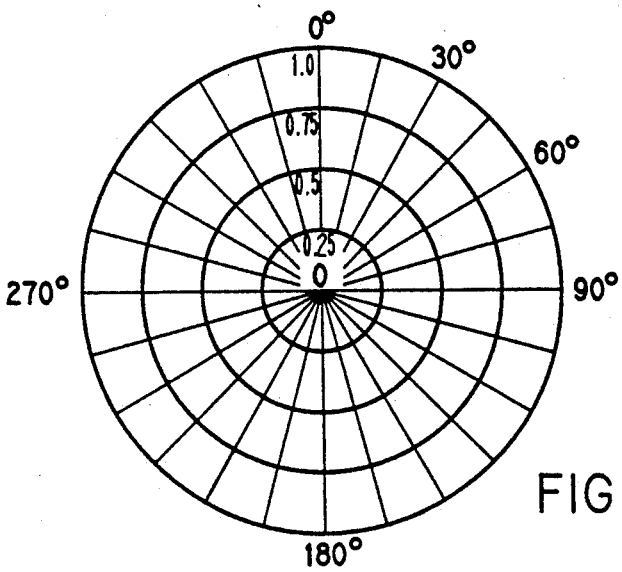
Figures 2D, 8:
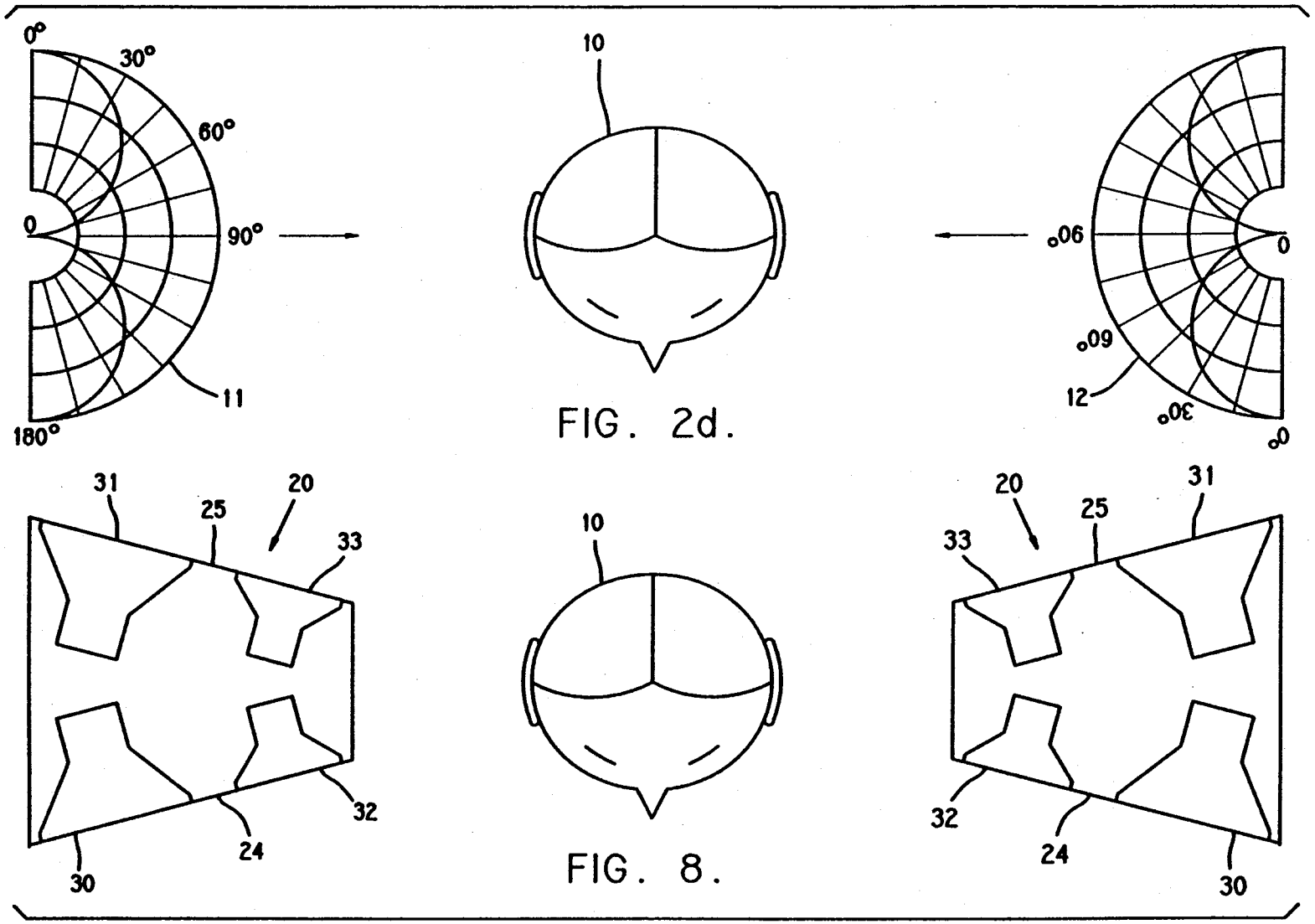
FIG. 2d illustrates how the nulls of side speakers like those in FIG. 1b have the nulls thereof pointed at the listener as noted earlier.
FIG. 8 illustrates a preferred speaker placement with respect to a listener according to the present invention.
Figure 3A:
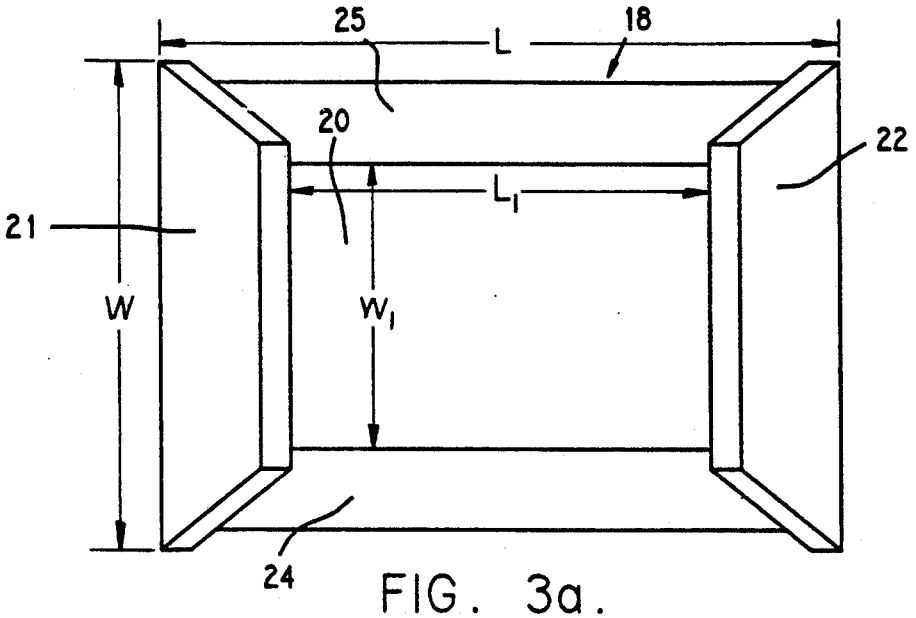
FIG. 3a is a perspective view of a preferred embodiment of a speaker enclosure according to the present invention.
Figure 3B:
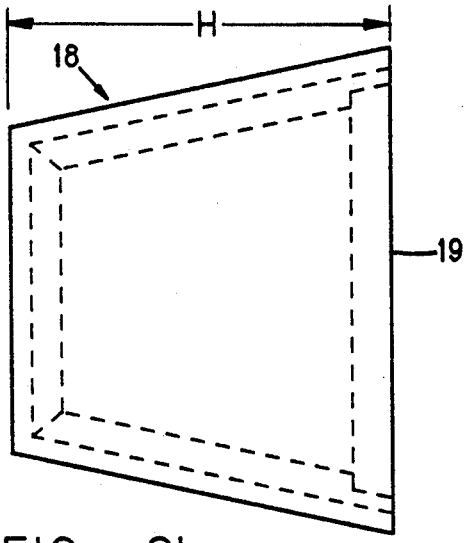
FIGS. 3b and 3c are respective end and side views thereof.
Figure 3C:
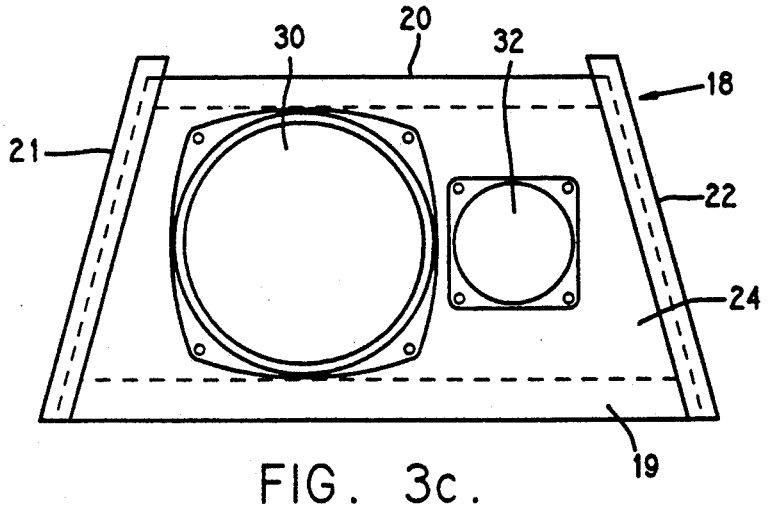

Turning now to the drawings, and first to FIGS. 3a–3c, a preferred embodiment of the present speaker system is shown at 18 and has a back or base 19 allowing the same to be placed on a table or mounted on a wall or ceiling, or the like. The enclosure 18 also includes a front (or top) 20 and sides 21 and 22. The speaker enclosure 18 further has a pair of oppositely directed baffle faces 24 and 25 (in this regard, note FIGS. 6a–6c where both baffle faces and associated speakers are diagrammatically shown). Each baffle face 24 and 25 is of a size to receive at least one dual voice coil speaker, and typically also a tweeter. Suitable openings (not shown) are provided for receiving these speakers, and two such speakers 30 and 32 are shown in the elevational view of FIG. 3c of the baffle face 24, it being understood that a similar pair of speakers is mounted in a like manner in the baffle face 25, although not shown in FIG. 3. Typical dimensions are an overall length L of eleven inches, width W of eight and one-half inches, and height H of six inches. The top 20 has a length L1 of seven inches and a width W1 of five inches.

Figure 4:
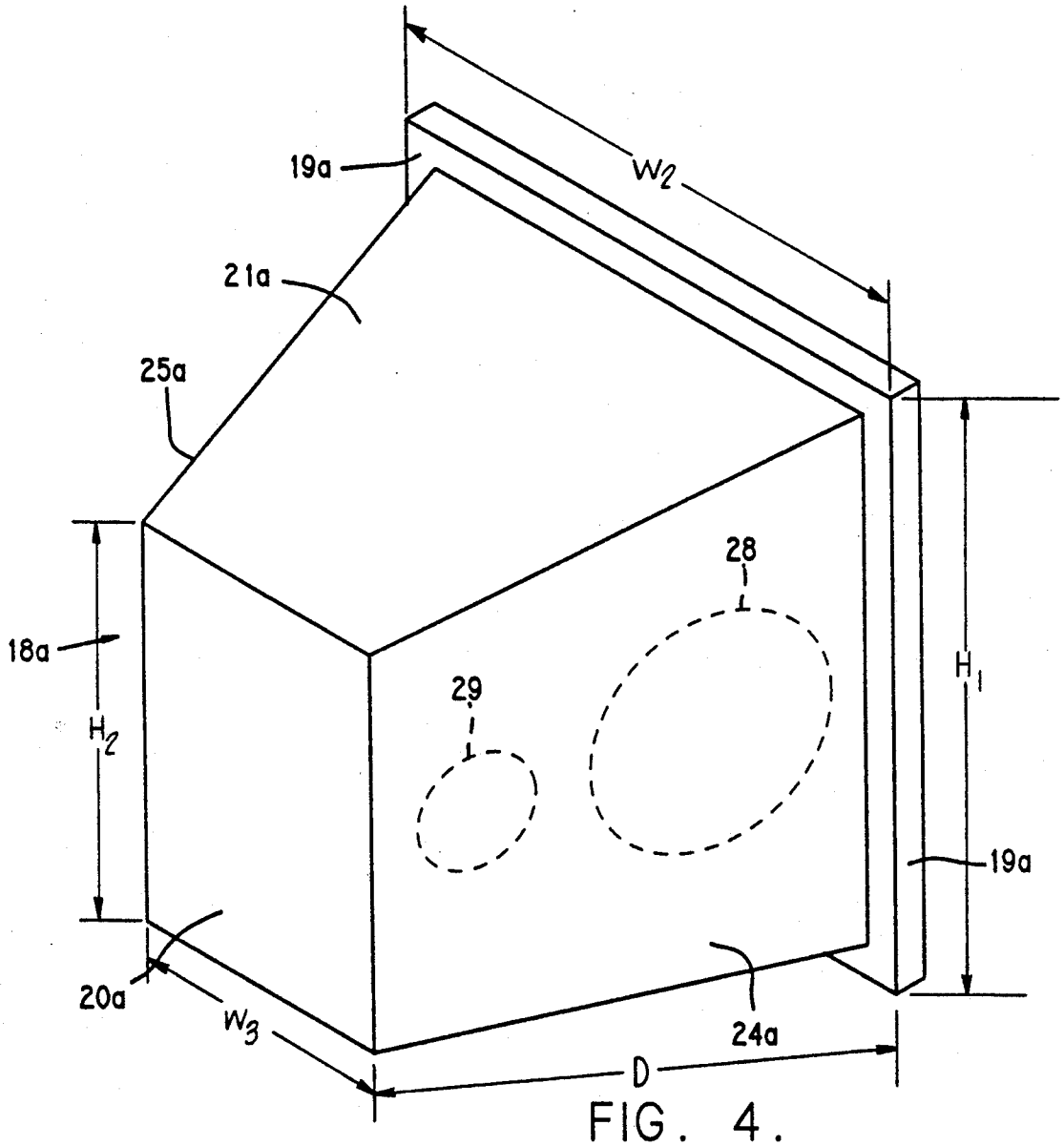
FIG. 4 is a perspective view of an alternative exemplary form of speaker enclosure according to the present invention.

FIG. 4 illustrates another embodiment of a typical speaker system or enclosure 18a according to the present invention having a back or base 19a allowing the same to be placed on the table or mounted on a wall or ceiling. This embodiment also has a front (or top) 20a and sides 21a and 22a. The enclosure 18a also has a pair of oppositely directed baffle faces 24a and 25a (face 25a not being seen in FIG. 4 but being opposite the face 24a—in this regard, note FIG. 6a–6c where both baffle faces 24 and 25 similar to baffle faces 24a and 25a are diagrammatically shown with associated speakers). Each baffle face as in the embodiment of FIG. 4 is of a size to receive at least one dual voice coil speaker, and typically also a tweeter. Openings 28 and 29 are diagrammatically indicated in FIG. 4 for these two speakers on baffle face 24a, it being understood that a like pair of holes for mounting speakers are provided on opposite baffle face 25a.

A typical width, height and depth for the configuration of the enclosure 20 as shown in FIG. 4 can be 8 ¼ inches wide (W2) by 7 ¼ inches high (H1) by six inches deep (D). The front dimension W3 may be 3 13/16 inches, and H2 4 7/16 inches thereby forming the frustotrapizoidal shape as seen in FIG. 4.

Figure 6A:
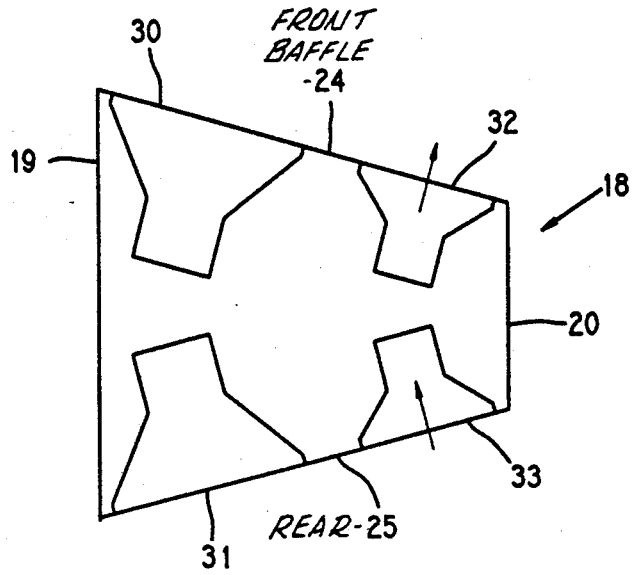
FIG. 6a–6c each illustrate a speaker system according to the present invention and show how the speakers are energized for high, mid and low, frequencies.
Figure 6B:
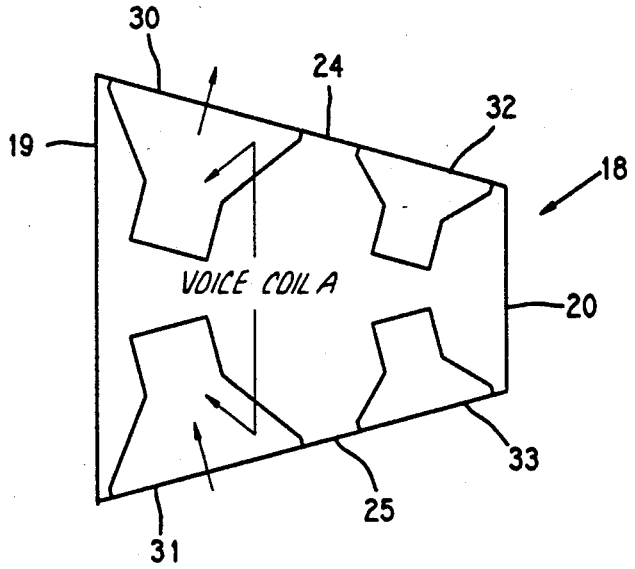
Figure 6C:
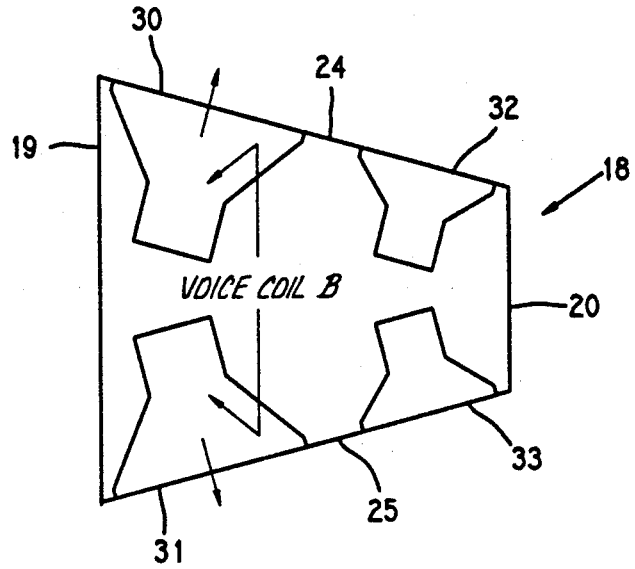

Turning now to FIGS. 6a–6c, the speaker enclosure 18 (or 18a) includes first and second dual voice coil speakers 30 and 31 mounted on the respective front baffle 24 and rear baffle 25, with these terms generally used as in the art to indicate the baffle 24 which faces the viewing screen (front) and the baffle 25 which faces away from (rear) the viewing screen. Front and rear high frequency speakers or tweeters 32 and 33 also are mounted on the respective baffles 24 and 25.

Figure 7A:
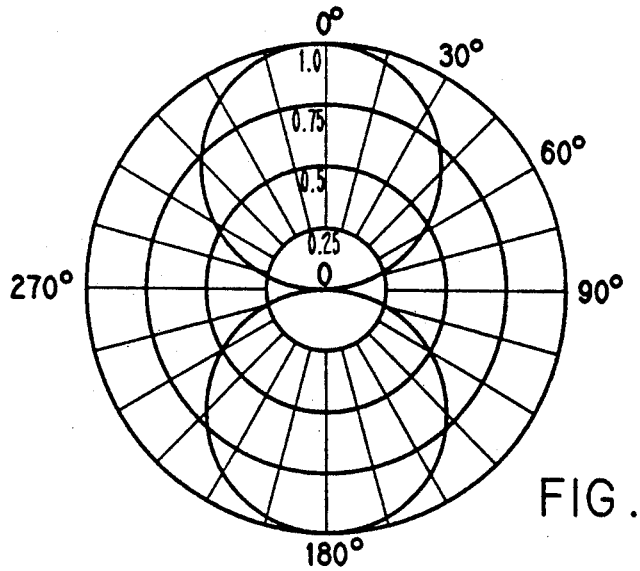
FIGS. 7a–7c illustrate the radiation patterns of the respective speaker systems of FIGS. 5a–5c.
Figure 7B:
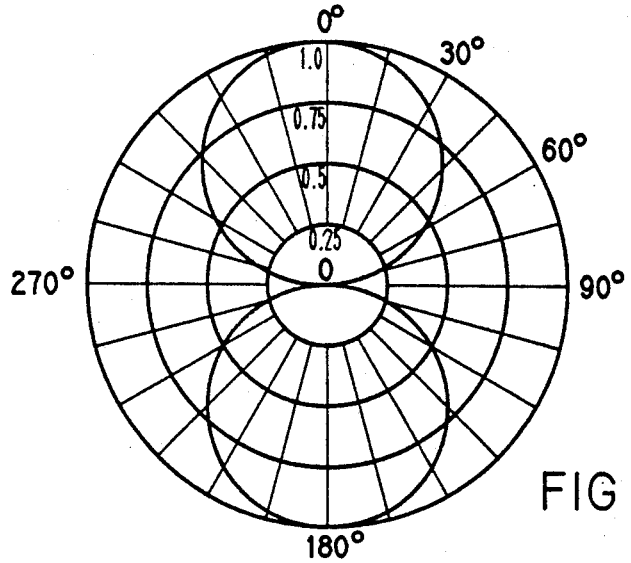
Figure 7C:
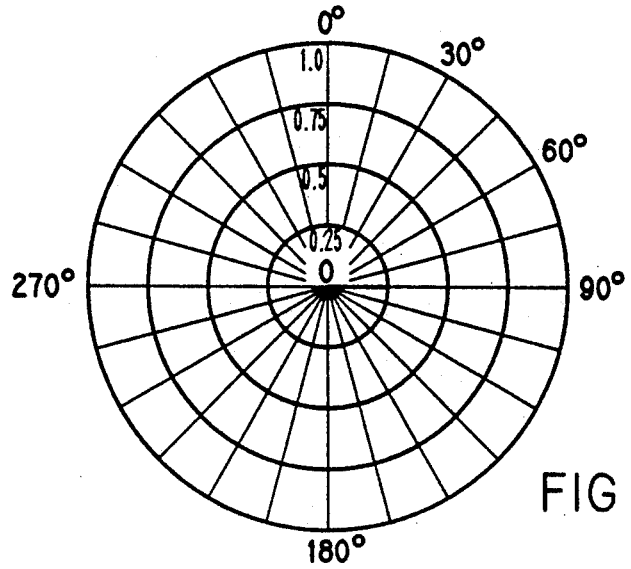

FIG. 7a illustrates the radiation pattern for the high frequency response of the speaker system of FIG. 6a. FIG. 7b illustrates the radiation pattern for the mid-frequency response of the speaker system, and FIG. 7c illustrates the frequency response at the low frequency end of the speaker system. Below approximately 200 hertz, one voice coil (voice coil B) of each speaker 30 and 31 (note FIG. 6c and FIG. 5), is driven in phase, thereby allowing the bass energy of these two speakers 30 and 31 to combine. Above approximately 200 hertz, one of the voice coils "A" of one speaker 30 or 31 is driven out-of-phase as illustrated in FIG. 6b thereby allowing for dipole cancellation in the mid-range and high frequencies. One of the tweeters or high frequency speakers 32 and 33 is driven out-of-phase at high and other frequencies as illustrated in FIG. 6a to further provide dipole cancellation at the high frequencies.

Thus, as will be further seen in FIG. 5 to be described later, on the front baffle 24, both voice coils of the dual voice coil driver and the voice coil of the tweeter are driven in-phase, and on the rear baffle 25, the second voice coil of the dual voice coil driver and the voice coil of the high frequency speaker are driven out-of-phase from those of the front baffle but in-phase with one another.

As will appear subsequently, all of the speakers can be operated through the same network and, consequently, the drivers responsible for the dipole cancellation effect have the same phase response and produce a more exact cancellation and null than found in speakers which roll-off the bass response of one woofer. Thus, the system as illustrated and according to the present invention, and as best shown in FIGS. 5, 6 and 7 provides good bass response at low frequencies, and functions as a dipole speaker in the mid-range (FIG. 6b) and high (FIG. 6a) frequencies.

Figure 5:
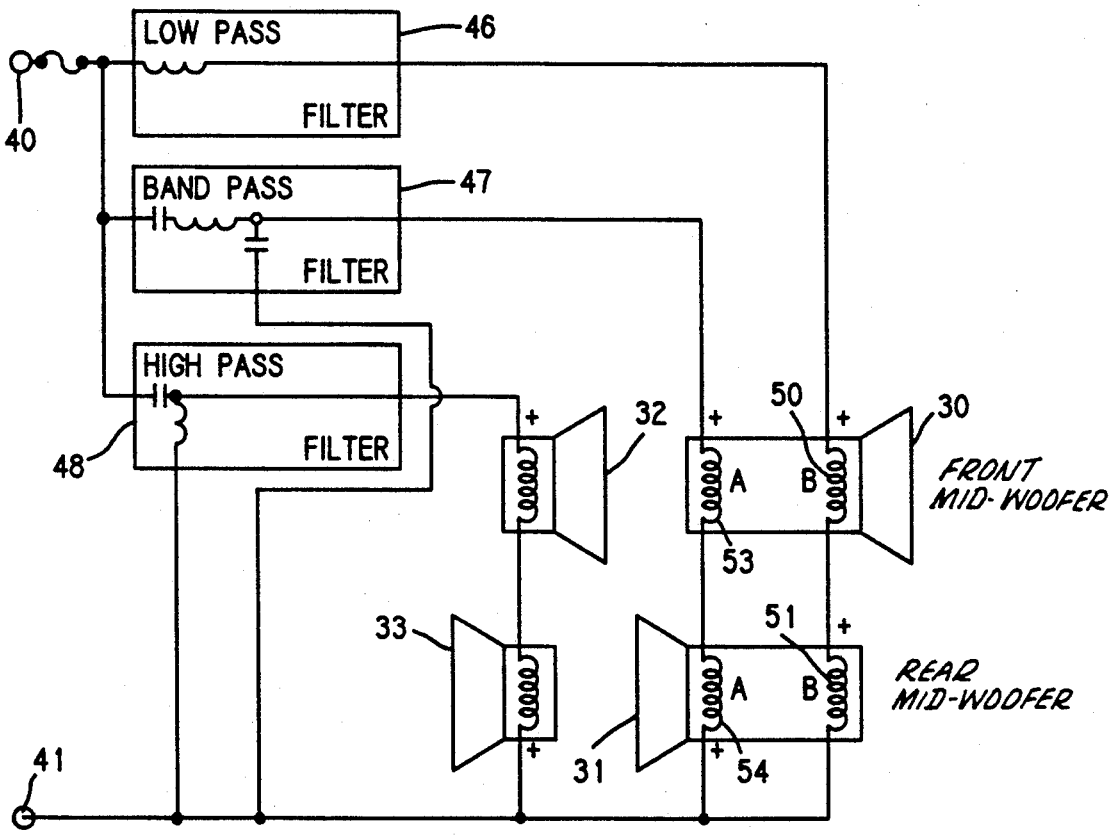
FIG. 5 is a circuit diagram illustrating the manner in which dual voice coil speakers, as well as tweeters, are connected with appropriate electrical filters according to the present invention.

Turning now to FIG. 5, the same illustrates the manner in which the speakers are connected with suitable filters according to a preferred embodiment of the present invention. The dual voice coil speakers 30 and 31 preferably may be dual voice coil polypropylene four inch woofers, and the tweeters 32 and 33 may be one-half inch polycarbonate dome tweeters. They are physically mounted to the baffles 24 and 25 of the enclosure 20 shown in FIG. 4 and as diagrammatically illustrated in FIG. 6. Terminals 40 and 41 are adapted to be connected to an amplifier (left or right as the case may be). with terminal 41 serving as a common terminal. Terminal 40 can be connected through a 1.1 ampere PTC device 43, for blow-out protection, if desired, to respective low pass, band pass and high pass filters 46, 47 and 48. The low pass filter 46 is intended to pass signals below approximately two hundred hertz, and may be a conventional series inductor as diagrammatically illustrated in FIG. 5. The filter 46 is connected to the "B" voice coils 50 and 51 of the respective front and rear mid/woofers 30 and 31 as shown. The plus (+) symbols in FIG. 5 illustrate, with respect to the voice coils "B" 50 and 51, that they are driven in phase so that the bass energy of the speakers 30 and 31 combine as previously discussed.

The bandpass filter 47 is connected to the "A" coils 53 and 54 of the dual voice coil speakers 30 and 31 as shown in FIG. 5, but these coils as indicated by the (+) plus symbol are driven out-of-phase with each other so that above approximately two hundred hertz dipole cancellation occurs in the mid-range and high frequencies. The bandpass filter 47 may be a typical inductor/-capacitor filter as diagrammatically illustrated in FIG. 5, for passing signals in the approximate two hundred to four thousand hertz range.

The high pass filter 48 is connected to the front and rear tweeters 32 and 33 which are connected out-of-phase with each other as indicated in FIG. 5, and this filter preferably passes signals above approximately four thousand hertz, and can be a typical capacitor/inductor high pass filter as illustrated in FIG. 5. Thus, voice coils 50 and 53 and the voice coil of the tweeter 32, as well as voice coil 51, are all connected in-phase with each other; whereas, coil 54 and the coil of the tweeter 33 are connected in-phase with each other but out-of-phase with coils 50, 51 and 53 and that of tweeter 32. A typical frequency response for the system shown and described is −3 dB @70 Hz. ±3 dB, 100 Hz to 7K hz @70 degrees off axis.

In the event the tweeters 32 and 33 are omitted, then a high pass filter is used instead of the bandpass filter 47 for the speaker coils A. The present invention requires a low pass filter to one voice coil (B) of a dual voice coil driver (30) and at least a high pass filter to the other coil (A)—with no tweeter used, this filter is a high pass filter (e.g., above approximately two hundred hertz) and if a tweeter (32) is used, this filter is the bandpass filter 47.

The enclosures 20 and 20*a* as shown in FIGS. 3 and 4 preferably are in the shapes of as previously indicated, and with the four speakers 30–33 mounted to the baffles 24 and 25 in a conventional manner to form the speaker assembly with speakers 30 and 32 serving as the front speakers and the speakers 31 and 33 serving as the rear speakers as generally illustrated in FIG. 6. Alternatively the speakers can be used to produce reverberation or other effects. A typical impedance is eight ohms nominal.

The relatively small size of the present speaker system and its enclosure is particularly advantageous because the small size facilitates placement alternatives, such as on a wall, ceiling or even on a table. In the preferred embodiment of FIG. 3 the enclosure shape is like a tapered wedge which is relatively thin and which resembles a modern day "exit" sign. This configuration has the advantage of being more "invisible" when installed on a ceiling or on a wall.

While embodiments of the present invention have been shown and described, various modifications may be made without departing from the scope of the present invention, and all such modifications and equivalents are intended to be covered.

What is claimed is:

1. A speaker system, such as for use in "surround" sound and other applications, comprising a speaker enclosure having first and second baffles generally intended to serve as respective front and rear baffles to be directed at and away from a viewing screen, the baffles each being adapted to have a loudspeaker mounted in an opening thereof, first and second dual voice coil speakers for providing mid-frequency and low frequency response, a first voice coil of each speaker being connected in an in-phase circuit and the second voice coil of each speaker being connected in an out-of-phase circuit, a low pass filter connected with the in-phase circuit to supply low frequency signals to the first voice coils, a bandpass filter connected to the out-of-phase circuit to provide mid-range frequency signals to the second voice coils, a pair of high frequency speakers respectively mounted to the first and second baffles and having voice coils connected together out-of-phase, and a high pass filter connected to the voice coils of the high frequency speakers.

2. A speaker system as in claim 1 wherein the low pass filter passes signals below approximately two hundred hertz, the high pass filter passes signals above approximately four thousand hertz, and the bandpass filter passes signals approximately between two hundred and four thousand hertz, (a) the first and second voice coils of the first dual voice coil speaker, the first voice coil of the second dual voice coil speaker, and the voice coil of one of the high frequency speakers are all connected in-phase with each other, and (b) the second voice coil of the second dual voice coil speaker and the voice coil of the other high frequency speaker are connected in-phase with each other but out-of-phase with the coils of (a) above.

3. A speaker system as in claim 1 wherein the dual voice coil speakers each comprise a four inch polypropylene woofer, and the high frequency speakers each comprise a one-half inch polycarbonate dome speaker.

4. A speaker system as in claim 3 wherein the low pass filter passes signals below approximately two hundred hertz, the high pass filter passes signals above approximately four thousand hertz, and the bandpass filter passes signals approximately between two hundred and four thousand hertz.

5. A speaker system such as for use in "surround" sound and other applications comprising a speaker enclosure having first and second baffles generally intended to serve as respective front and rear baffles to be directed at and away from a viewing screen, the baffles each being adapted to have a loudspeaker mounted therein, first and second dual voice coil speakers for providing mid-frequency and low frequency response, a first voice coil of each speaker being connected in an in-phase circuit and the second voice coil of each speaker being connected in an out-of-phase circuit, a low pass filter connected with the in-phase circuit to supply low frequency signals to the first voice coils, and a second filter connected to the out-of-phase circuit to provide at least mid-range frequency signals to the second voice coils.

6. A speaker system as in claim 5 wherein the low pass filter passes signals below approximately two hundred hertz, and the second filter passes signals above approximately two hundred hertz.

7. A speaker system as in claim 5 further including a pair of high frequency speakers respectively mounted to the first and second baffles and having voice coils connected together out of phase, a high pass filter connected to the voice coils of the high frequency speakers, and the second filter is a bandpass filter.

8. A speaker system comprising a speaker enclosure having first and second oppositely facing baffles with each being adapted to have a loudspeaker mounted in an opening thereof, first and second dual voice coil speakers for providing mid-frequency and low frequency response being mounted on respective first and second baffles, a first voice coil of each speaker being connected together in an in-phase circuit and the second voice coil of each speaker being connected together in an out-of-phase circuit, a low pass filter connected with the in phase circuit to supply low frequency signals to the first voice coils, and a bandpass filter connected to the out-of-phase circuit to provide mid-range frequency signals to the second voice coils.

9. A speaker system as in claim 8 including a pair of high frequency speakers respectively mounted to the first and second baffles and having voice coils connected together out-of-phase, and a high pass filter connected to the voice coils of the high frequency speakers.

10. A speaker system as in claim 9 wherein the low pass filter passes signals below approximately two hundred hertz, the high pass filter passes signals above approximately four thousand hertz, and the bandpass filter passes signals approximately between two hundred and four thousand hertz.

11. A speaker system as in claim 9 wherein the speaker enclosure has essentially a wedge shape with the first and second baffles forming oppositely facing walls of the enclosure.

12. A dipole speaker system having a radiation pattern with a null to allow a listener to be positioned in the vicinity of the null comprising a speaker enclosure having first and second oppositely facing baffles with each being adapted to have loudspeakers mounted in openings thereof, first and second dual voice coil speakers for providing mid-frequency and low frequency response being mounted on respective first and second baffles, a first voice coil of each speaker being connected together in an in-phase circuit and the second voice coil of each speaker being connected together in an out-of-phase circuit, a low pass filter connected with the in phase circuit to supply low frequency signals to the first voice coils, a bandpass filter connected to the out-of-phase circuit to provide mid-range frequency signals to the second voice coils, a pair of high frequency speakers respectively mounted to the first and second baffles and having voice coils connected together out-of-phase, and a high pass filter connected to the voice coils of the high frequency speakers.

13. A dipole speaker system having a radiation pattern with a null to allow a listener to be positioned in the vicinity of the null comprising a speaker enclosure having first and second oppositely facing baffles with each being adapted to have loudspeakers mounted in openings thereof, first and second dual voice coil speakers for providing mid-frequency and low frequency response being mounted on respective first and second baffles, each of said dual voice coil speakers having first and second voice coils, first and second high frequency speakers respectively mounted to the first and second baffles, and each having a voice coil, the first and second coils of the first dual voice coil speaker, the first coil of the second dual voice coil speaker, and the coil of the first high frequency speaker all being in-phase with each other and out-of-phase with the second coil of the second dual voice coil speaker and coil of the second high frequency speaker, the second coil of the second dual voice coil speaker and coil of the second high frequency speaker being in-phase with each other, a low pass filter connected to supply low frequency signals to the first voice coils of the first and second dual voice coil speakers, a bandpass filter connected to provide mid-range frequency signals to the second voice coils of the first and second dual voice coil speakers, and a high pass filter connected to the voice coils of the high frequency speakers.

14. A speaker system as in claim 13 wherein the low pass filter passes signals below approximately two hundred hertz, the high pass filter passes signals above approximately four thousand hertz, and the bandpass filter passes signals approximately between two hundred and four thousand hertz.

15. A speaker system as in claim 14 wherein the dual voice coil speakers each comprise a four inch polypropylene woofer, and the high frequency speakers each comprise a one-half inch polycarbonate dome speaker.

* * * * *